US006438338B1

(12) United States Patent
Mark et al.

(10) Patent No.: US 6,438,338 B1
(45) Date of Patent: Aug. 20, 2002

(54) EXTENDED LIFE RECYCLEABLE SILENCER ASSEMBLY

(75) Inventors: Richard C. Mark; Richard L. Carlston; David Battat, all of Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/692,766

(22) Filed: Oct. 19, 2000

(51) Int. Cl.[7] ..... G03G 15/00
(52) U.S. Cl. ..... 399/91; 399/159
(58) Field of Search ..... 399/91, 116, 117, 399/159

(56) References Cited

U.S. PATENT DOCUMENTS 5,722,016 A 2/1998 Godlove et al. ..... 399/159
5,960,236 A 9/1999 Zaman et al. ..... 399/91
6,205,308 B1 * 3/2001 Tanaka et al. ..... 399/159

FOREIGN PATENT DOCUMENTS

JP 63030481 3/1988
JP 63271388 11/1988

* cited by examiner

*Primary Examiner*—William J. Royer
(74) *Attorney, Agent, or Firm*—Taliam I. Nguti

(57) ABSTRACT

A silencer assembly that has an extended life, is recycleable and suitable for reducing screeching noises between a cleaning blade and an imaging member of an electrostatographic reproduction machine. The silencer assembly includes (i) a first C-shaped member having a wall defining a slot extending axially in the wall, and an interior cavity having a predetermined inside diameter in the free state, (ii) at least one partially compressed high density polymeric open cell foam plug inserted into the interior cavity, and (iii) a replaceable second C-shaped member inserted within the interior cavity for reducing plastic deformation of the first C-shaped member, thereby extending life of the silencer and making the silencer easily recyclable by replacing the second C-shaped member.

14 Claims, 4 Drawing Sheets

EXTENDED LIFE RECYCLEABLE SILENCER ASSEMBLY

BACKGROUND OF THE INVENTION

This invention relates in general to electrostatographic reproduction machines, and more particularly to an extended life and recycleable silencer assembly for reducing screeching noises between a cleaning blade and an imaging member of an electrostatographic reproduction machine.

Electrostatographic imaging members are well known in the art. The imaging members may be in the form of various configurations such as a flexible web type belt or cylindrical drum. The drums comprise a hollow cylindrical substrate and at least one electrostatographic coating. These drums are usually supported by a hub held in place at the end of the drum. The hub usually includes a flange that extends into the interior of the drum and is usually retained in place by an adhesive. An axle shaft through a hole in the center of the hub supports the hub and drum assembly.

Electrostatographic imaging members as such may be electrostatographic or electrographis members. It is well known that electrostatographic members comprise at least one photosensitive imaging layer and are imaged with the aid of activating radiation in image configuration whereas electrographic imaging members comprise at least one dielectric layer upon which an electrostatic latent image is formed directly on the imaging surface by shaped electrodes, ion streams, styli and the like. A typical electrnstatographic imaging process cycle involve storming an electrostatic latent image on the imaging surface, developing the electrostatic latent image to form a toner image, transferring the toner image to a receiving member and cleaning the imaging surface. Cleaning of the imaging surface of electrostatographic imaging members is often accomplished with a doctor type resilient cleaning blade that is rubbed against the imaging surface of the imaging members.

When electrostatographic imaging member are cleaned by doctor type cleaning blades rubbing against the imaging surface to remove residual toner particles remaining on the imaging surface after toner image transfer to a receiving member, a high pitched ringing, squealing, squeaking, or howling sound can be created which is so intense that it is intolerable for machine operators. This is especially noted in drum type imaging members comprising a hollow cylindrical substrate. The sound apparently is caused by a "stick-slip" cycling phenomenon during which the cleaning blade initially "sticks" to the imaging surface and is carried in a downstream direction by the moving imaging surface to a point where resilience of the imaging blade forces the tucked blade to slip and slide back upstream where it again sticks to the imaging member and is carried downstream with the imaging surface until blade resilience again causes the blade to flip back to its original position.

The upstream flipping motion kicks residual toner particles forward. The stick-slip phenomenon is somewhat analogous to the use of a push broom for cleaning floors where the push broom is most effective for cleaning when it is pushed a short distance and then tapped on the floor with the cycle being repeated again and again. This stick-slip phenomenon is important for effective removal of residual untransferred toner particles from an imaging surface and for prevention of undesirable toner film or toner comets from forming on the imaging surface during cleaning.

An adhesive relationship between the cleaning blade and the imaging member surface appears to contribute to the creation of the ringing, squealing, squeaking, or howling sound. More specifically, the stick-slip effect occurs where there is a strong adhesive interaction between the cleaning blade and the imaging surface. The ringing, squealing, squeaking, or howling sound appears to be caused by resonant vibration of the drum induced by the stick-slip phenomenon. Other factors contributing to creation of the ringing, squealing, squeaking, or howling sound may include factors such as the construction of the imaging member, the blade contacting the imaging member, the type of blade holder construction, and the like. For example, a flimsy blade holder can contribute to the howling effect. Moreover, a thinner, shorter, stubbier cleaning blade tends to contribute to the howling effect. Thin imaging member drums can also lead to the howling effect.

The stick-slip phenomenon also depends on the lubricating effect of toner and/or carrier materials utilized. Moreover, ambient temperatures can contribute to the creation of howling. It appears that resonance is initiated at the point of contact between the cleaning blade and the imaging member. The creation of the squealing or howling sound might be analogous to rubbing a fingertip around the edge of a wine glass. The squealing or howling noise phenomenon is especially noticeable for cylindrical photoreceptors having a hollow metal or plastic drum shaped substrate. Generally, where the imaging member is the cause of a howling sound, it will emit a ringing sound when tapped.

These sounds cannot be tolerated in a office environment. To overcome this drawback, various devices have been developed which can be inserted inside the hollow drum to dampen the drum and diminish or eliminate all irritating sounds emitted during an imaging operation. Some of these devices include, for example, porous members which are compressed when inserted inside a hollow photoreceptor drum to perform a sound deadening function while pressing against the inner surface of the drum. Examples of this type of sound dampener are described, in U.S. patent application No. 5,722,016, Japanese Patent Publication 63060481, published Mar. 16, 1998 and Japanese Patent Publication 63271388, published Nov. 9, 1998.

Another such device for preventing undesirable sounds in a drum photoreceptor includes a control member having a "C" cross-section. This type of device is described, for example, in Japanese Patent Publication 02118684, published May 2, 1990. This device is difficult to compress and slide into a hollow drum unless the control member is very thin. A very thin control member may not have sufficient mass to dampen any squeaking sound. However, thicker silencer members having a "C" shaped cross-section may be utilized if modified to form a hinge of thinner material extending axially along the length of the "C" shaped member. The hinge of thinner material is preferably located opposite the gap of the "C" shaped member. This hinge allows a relatively thick silencer to be more easily squeezed so that the exposed ends at the longitudinal gap come together to form a silencer having a smaller cross-section thereby allowing the silencer to be inserted into the hollow drum. This arrangement also facilitates removal of the silencer from the drum for recycling.

Unfortunately, it has been found that where a silencer having a "C" shaped cross-section and a hinge is utilized in a photoreceptor drum that has been cycled many thousands of cycles, the cross-sectional area of the silencer becomes smaller due to the silencer taking a "set" while it's in the compressed mode within the interior of the drum. Thus, upon removal of the silencer for recycling and use in a fresh drum, the silencer loses its effectiveness for dampening sounds due to insufficient pressure contact between the silencer and the interior of the drum. Both the outside diameter and inside diameter of the "C" shaped silencer become smaller with use. Such reduction is believed to be the result of plastic deformation while under partial compression in the interior of a hollow photoreceptor drum. Thus, over time, such silencers, e.g. PVC silencers, become relaxed and no longer apply outward pressure to the inside diameter of the silencer. This causes the silencer to rattle within the photoreceptor causing more noise.

Thus, there is a continuing need for an extended life and recycleable silencer assembly for reducing screeching noises between a cleaning blade and the imaging member of an electrostatographic reproduction machine.

SUMMARY OF THE INVENTION

In accordance with the present invention, there is provided a silencer assembly that has an extended life, is recycleable and suitable for reducing screeching noises between a cleaning blade and an imaging member of an electrostatographic reproduction machine. The silencer assembly includes (i) a first C-shaped member comprising a wall defining a slot extending axially in the wall, and an interior cavity having a predetermined inside diameter in the free state, (ii) at least one partially compressed high density polymeric open cell foam plug inserted into a portion of the interior cavity, and (iii) a replaceable second C-shaped member inserted within the interior cavity for reducing plastic deformation of the first C-shaped member, thereby extending life of the silencer assembly and making the silencer assembly easily recyclable.

BRIEF DESCRIPTION OF THE DRAWINGS

In general, the advantages of the improved drum supporting hub and drum assembly will become apparent upon consideration of the following disclosure of the invention, particularly when taken in conjunction with the accompanying drawings wherein.

These figures merely schematically illustrate the invention and are not intended to indicate relative size and dimensions of actual devices and components thereof.

DETAILED DESCRIPTION OF THE DRAWINGS

The present invention may be employed in any suitable electrostatographic imaging member comprising a cylindrical drum substrate and at least one electrostatographic imaging layer that generates high pitched ringing, squealing, squeaking, or howling sounds when utilized with a cleaning device such as a cleaning blade or any other proximal device which causes vibrations, especially in the audible range, to be generated in the aforementioned electrostatographic imaging member. However, for purposes of illustration, the invention will be described with reference to an electrostatographic imaging drum.

Figure 1:
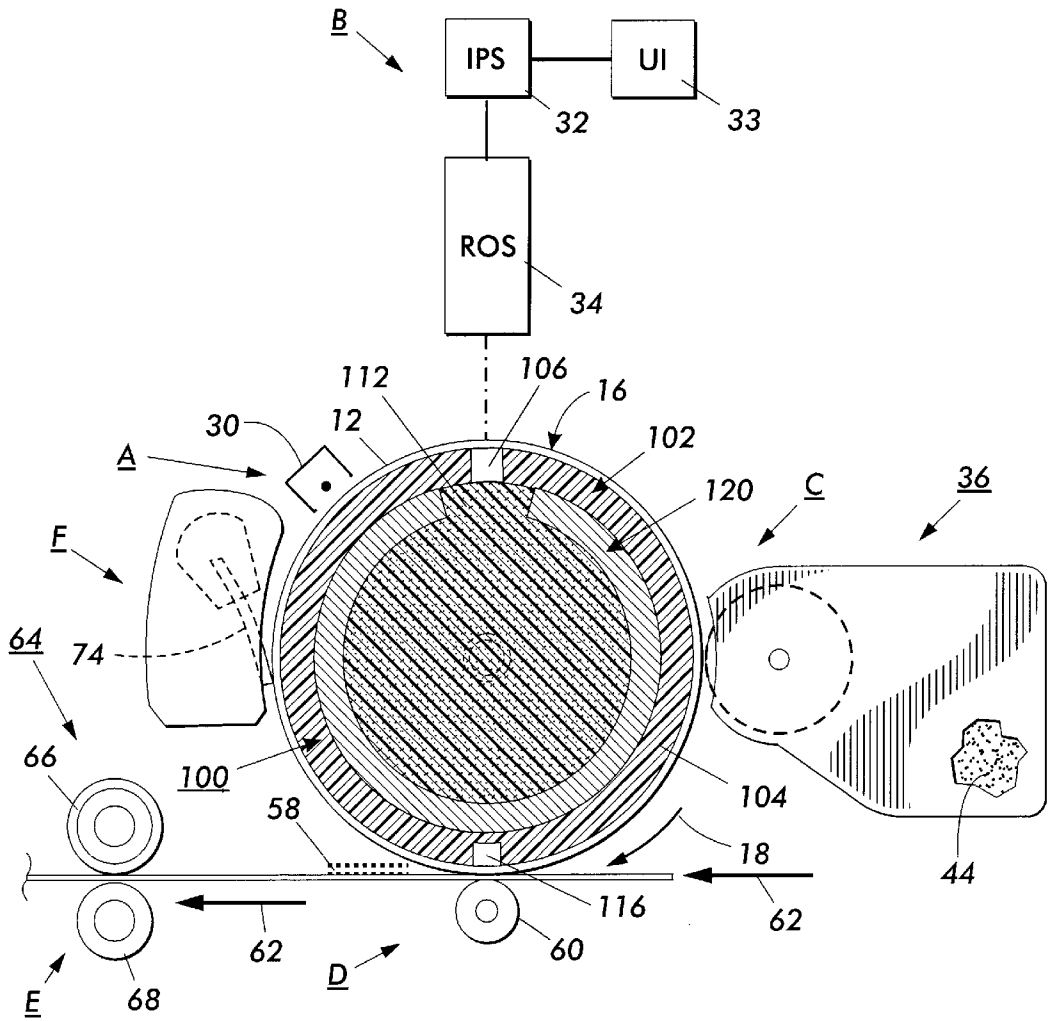
FIG 1 is a schematic elevational view of an illustrative electrostatographic reproduction machine incorporating the extended life recyclable silencer assembly of the present invention.

Referring now to FIG. 1, the electrostatographic reproduction machine of the present invention is shown. The machine employs a photoconductive drum 16, although photoreceptors in the form of a belt are also known, and may be substituted therefor. The drum 16 has a photoconductive surface deposited on a conductive substrate. Drum 16 moves in the direction of arrow 18 to advance successive portions thereof sequentially through the various processing stations disposed about the path of movement thereof.

Initially successive portions of drum 16 pass through charging station A. At charging station A, a corona generating device, indicated generally by the reference numeral 30, charges the drum 16 to a selectively high uniform electrical potential. The electrical potential is normally opposite in sign to the charge of the toner. Depending on the toner chemical composition, the potential may be positive or negative. Any suitable control, well known in the art, may be employed for controlling the corona generating device 30.

Next, the charged portion of photoconductive surface 12 is advanced through exposure station B. At exposure station B, information that is indicative of the pages to be printed is transmitted to an image processing system (IPS), indicated generally by the reference numeral 32. IPS 32 is the control electronics which prepare and manage the image data flow to raster output scanner (ROS), indicated generally by the reference numeral 34. A user interface (UI), indicated generally by the reference numeral 33, is in communication with the IPS. The UI enables the operator to control the various operator adjustable functions. The output signal from the UI is transmitted to IPS 32. The signal corresponding to the desired image is transmitted from IPS 32 to ROS 34, which creates the output copy image. ROS 34 lays out the image in a series of horizontal scan lines with each line having a specified number of pixels per inch. The ROS includes a laser having a rotating polygon mirror block associated therewith. The ROS exposes the charged photoconductive surface of the printer.

At development station C, a development system or unit, indicated generally by the reference numeral 36 advances developer materials into contact with the electrostatic latent images. The development unit includes a device to advance developer material into contact with the latent image. The development unit 36 develops the charged image areas of the photoconductive surface. This developer unit contains, for example, black developer material 44 having a triboelectric charge such that the black toner is attracted to charged areas of the latent image on surface 12.

A sheet of support material 58 is moved by means (not shown) into contact with the toner image at transfer station D. As shown, transfer station D includes a corona generating device 60 which sprays ions of a suitable polarity onto the backside of sheet 58. This attracts the toner powder image from the drum 16 to sheet 58. After transfer, the sheet continues to move, in the direction of arrow 62 to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a pressure roller 68. Sheet 58 passes between fuser roller 66 and pressure roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator. It will also be understood that other post-fusing operations can be included, for example, binding, inverting and returning the sheet for duplexing and the like.

After the sheet of support material is separated from the photoconductive surface of drum 16, the residual toner particles carried by the image and the non-image areas on the photoconductive surface are removed at cleaning station F. The cleaning station F includes a blade 74.

Referring to FIGS. 1–4, in order to prevent generation of high pitched ringing, squealing, squeaking, or howling sounds when the blade 74 is used as above to clean the surface 12 of electrostatographic imaging member or drum 16, the machine 8 includes an extended life and recyclable silencer assembly 100 of the present invention. A background silencer, that suffers from the disadvantages addressed by the present invention, is disclosed in commonly assigned U.S. Ser. No. 09/143,049, currently issued as U.S. Pat. No. 5,960,236 on Sep. 28, 1999, and of which teaching portions thereof are incorporated herein by reference.

As shown, the silencer assembly 100 includes (i) an elongate first C-shaped member in the form of a hollow tube 102 comprising a wall 104 defining a slot 106 extending axially relative to, and through, the wall 104. An inner surface 108 of the wall 104 defines an interior cavity 110 having a predetermined inside diameter in the freestate, (ii) at least one partially compressed high density polymeric open cell foam plug 112 inserted into the interior cavity 110, and (iii) a replaceable second C-shaped member 120 inserted within the interior cavity 110 for reducing plastic deformation of the first C-shaped member 102, thereby extending life of the silencer assembly, and making the silencer assembly easily recyclable by replacing the second C-shaped member 120.

As illustrated, the silencer assembly 100 also includes at least one partially compressed high density polymeric open cell foam plug 112 in the interior cavity 110 of the tube 102. The partially compressed high density polymeric open cell foam plug 112 in the uncompressed state has a substantially circular cross section in at least one plane. The circular cross section as such has an outside diameter that is sufficient to increase or expand the inside diameter of the hollow tube 102 to a diameter at least about 5 percent greater than the predetermined inside diameter of the hollow tube in the free state (i.e. unencumbered state with no plug in the interior of tube 102). Hollow tube 102 comprises a wall 104 having a substantially uniform thickness, a hard exterior surface 114 and an inner surface 108 defining the,cavity 110. Hollow tube 102 may comprise any suitable material such as plastic, metal, composites and the like.

As further shown, hollow tube 102 also contains at least one groove 116 extending parallel to the imaginary axis thereof, and having a depth that is less than the thickness of the tube wall 104. In addition, hollow tube 102 contains a slot 106 through wall 104 and extending parallel to the imaginary axis of tube 102. Although the slot 106 is illustrated as a straight slot, any other suitable shape may be utilized such as a slot having a wavy, sawtooth or spiral pattern. However, a straight slot is preferred for simplicity of manufacture aid reduced cost.

The plane of the circular cross section of the plug 112 is ideally, but not necessarily, perpendicular to the imaginary axis of hollow tube 102 when plug 112 is installed within the interior cavity 110 of tube 102. Increasing the inside diameter of the hollow tube 102 to a diameter at least about 5 percent greater than the predetermined inside diameter of the hollow tube in the free state, in combination with partially compressed plug 112, ensures positive pressure contact between hard exterior surface 114 and the interior surface of a photoreceptor drum (not shown). The silencer assembly 100 further includes the second C-shaped member 120, which preferably is a flat, stainless steel "C" spring that pushes against the inner surface 108 and thus maintains pressure contact between the hard exterior surface 114 of tube 102 and the interior surface of a photoreceptor drum 16. This coupled with the mass of hollow tube 102 and the effect of the plug 112 substantially eliminates relative movement between silencer assembly 100 and the photoreceptor drum 16, and thereby ensures elimination of the high pitched ringing, squealing, squeaking, or howling sounds.

Figure 2:
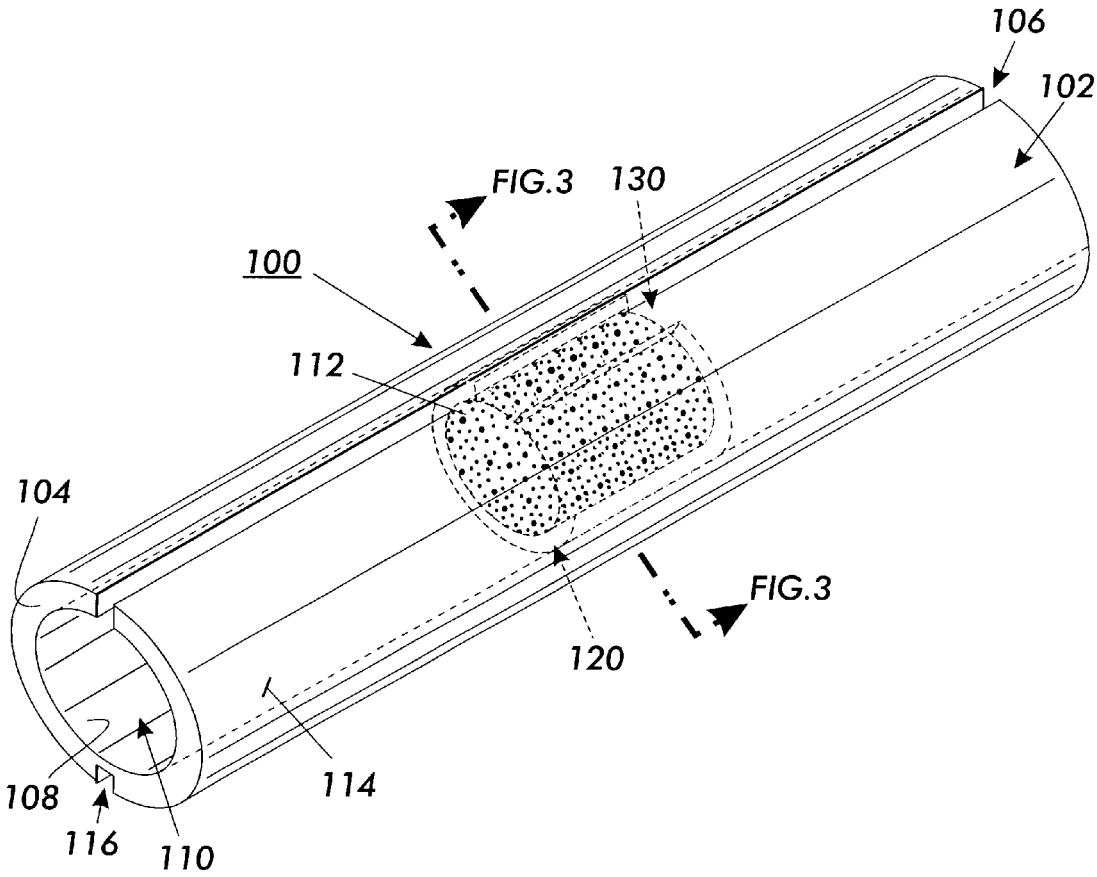
FIG. 2 is illustrates an isometric view of the extended life recyclable silencer assembly of the present invention.
Figure 3:
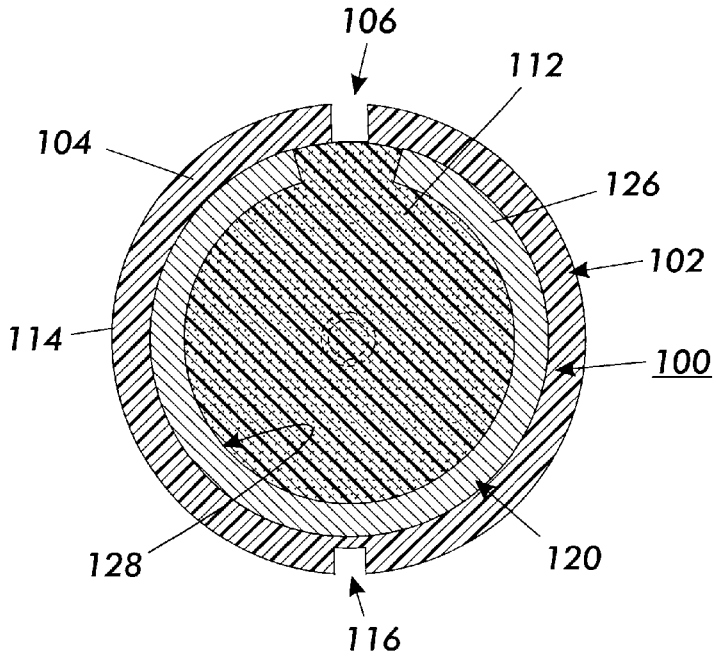
FIG. 3 illustrates a cross-sectional end view along plane 3—3 of a first embodiment of the extended life recyclable silencer assembly of the present invention.

In FIGS. 1–3, a first embodiment of the silencer assembly 100 of the present invention is shown, and includes the hollow tube 102 as a first C-shaped member which can be a recycled tube, having the hard exterior surface 114, groove 116, slot 106 and partially compressed high density polymeric open cell foam plug 112 inserted within the center portion of the assembly 100. Importantly, the silencer assembly 100 also includes the second C-shaped member 120 in the form of a flat spring which as shown in this embodiment is inserted between the plug 112 and the inner surface of the first C-shaped member or hollow tube 102.

Figure 5:
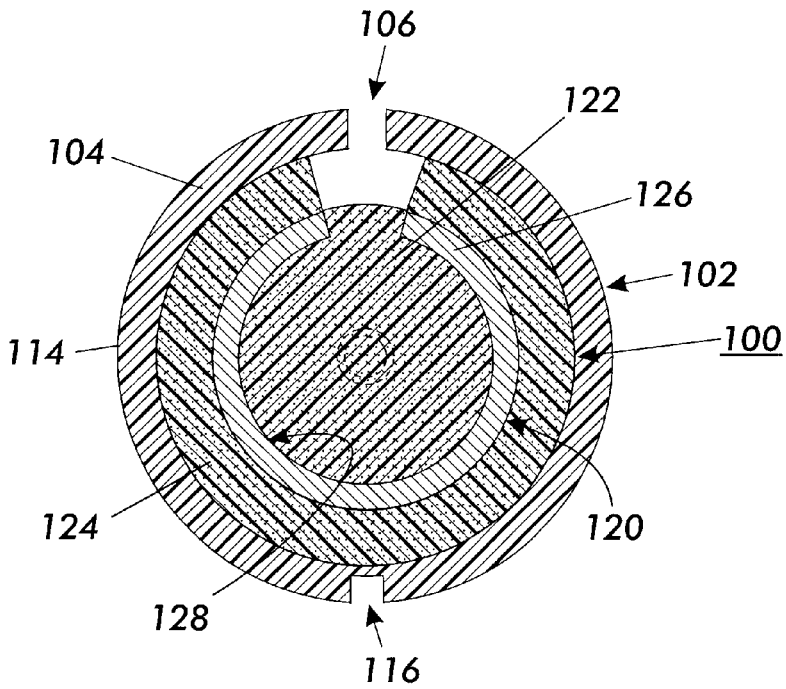
FIG. 5 illustrates a cross-sectional end view, similar to that of FIG. 3, but of a second embodiment of the extended life recyclable silencer assembly of the present invention.

In FIG. 5, a cross-sectional end view of a second embodiment of the silencer assembly 100 of the present invention is shown. This embodiment also includes the hollow tube 102 as a first C-shaped member which can be a recycled tube, having the hard exterior surface 114, groove 116, slot 106 and partially compressed high density polymeric open cell foam plug 112. Importantly, the silencer assembly 100 also includes the second C-shaped member 120 in the form of a flat spring. In this embodiment however, the plug 112 comprises a first portion 122 inserted within the center portion of the assembly 100, and a second portion 124 inserted between the first and the second C-shaped members 102, 120 respectively.

Figure 6:
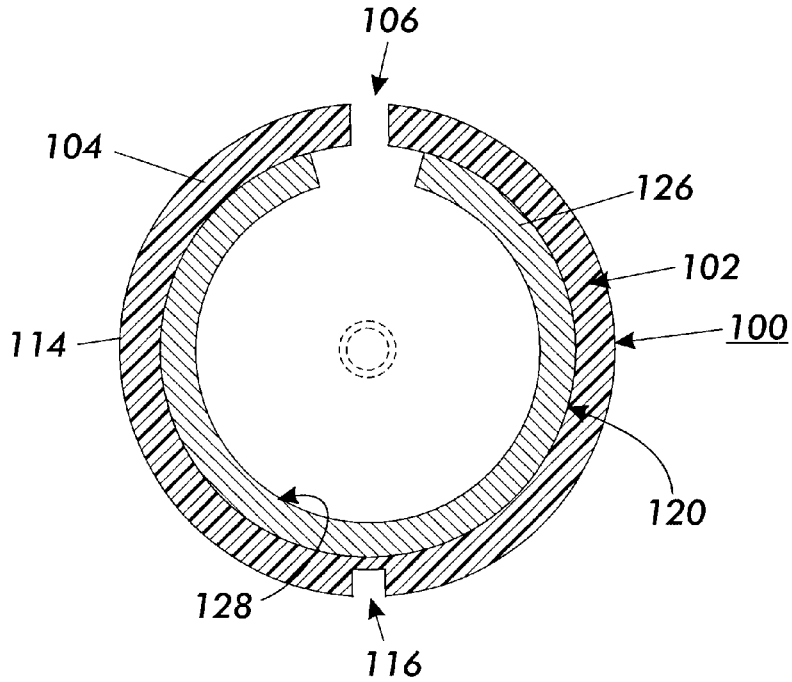
FIG. 6. illustrates a cross-sectional end view that of FIG. 3, but of a third embodiment of the extended life recyclable silencer assembly of the present invention.

In FIG. 6, a cross-sectional end view of a third embodiment of the silencer assembly 100 of the present invention is shown. This embodiment also includes the hollow tube 102 as a first C-shaped member which can be a recycled tube, having the hard exterior surface 114, groove 116, and slot 106. This embodiment however does not include a partially compressed high density polymeric open cell foam plug. It merely includes the second C-shaped member 120 in the form of a flat spring inserted within the interior cavity 110, and in spring contact with the inner surface 108 of the first C-shaped member or hollow tube 102.

Figure 4:
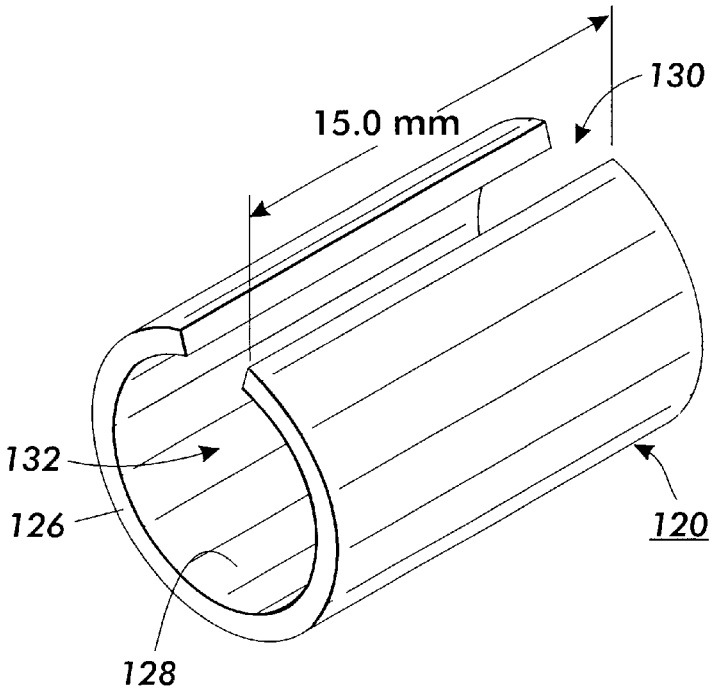
FIG. 4 illustrates an isometric view of the C-shaped flat spring member of the extended life recyclable silencer assembly of the present invention.

As further illustrated in FIG. 4, the second C-shaped member 120 is a flat expansion spring, preferably made of stainless steel. As shown, the second C-shaped member 120 is comprised of a stainless steel wall 126 having an inner surface 128 defining a slot 130 and an interior cavity 132. In accordance with the present invention, the second C-shaped member 120 is made so that its diameter fits appropriately within the first C-shaped member or tube 102, depending on the particular embodiment, first and third or second embodiments. In either case, the flat expansion spring 120 should have thickness of about 1.5 mm, a width of about 15.0 mm as shown, and an expansion force within a range of 1:25 to 2:23 kg/mm pushing outwards towards the first C-shaped member or tube 102. For remanufacture, all it requires is insertion or replacement of the steel spring or second C-shaped member 120. Thereafter, the silencer assembly 100 may be reused without any further remanufacturing costs.

As can be seen, there has been provided a silencer assembly that has an extended life, is recycleable and suitable for reducing screeching noises between a cleaning blade and the imaging member of an electrostatographic reproduction machine. The silencer assembly includes (i) a first C-shaped member comprising a wall defining a slot extending axially in the wall, and an interior cavity having a predetermined inside diameter in the free state, (ii) at least one partially compressed high density polymeric open cell foam plug inserted into the interior cavity, and (iii) a replaceable second C-shaped member inserted within the interior cavity for reducing plastic deformation of the first C-shaped member, thereby extending life of the silencer and making the silencer easily recyclable by replacing the second C-shaped member.

While the invention has been described in detail with particular reference to preferred embodiments thereof, it will be understood that variations and modifications can be effected within the spirit and scope of the invention as described herein above and as defined in the appended claims.

What is claimed is:

1. An extended life and recycleable silencer assembly for reducing screeching noises between a cleaning blade and an imaging member of an electrostatographic reproduction machine, the silencer assembly comprising:

(a) a first C-shaped member having a hollow interior and an exterior surface for contacting an interior surface of the imaging member;

(b) a second C-shaped member inserted into said hollow interior of said first C-shaped member for preventing early relaxation of said first C-shaped member, thus extending a life of said first C-shaped member and making the silencer assembly easily recyclable by merely adding said second C-shaped member; and (c) at least one partially compressed preformed high density polymeric open cell foam plug within said hollow interior of said first C-shaped member.

2. The silencer assembly of claim 1, wherein said first C-shaped member comprises a non-metallic tube.

3. The silencer assembly of claim 2 wherein said first C-shaped member is made of polyvinyl chloride (PVC) material.

4. The silencer assembly of claim 2 wherein said first C-shaped member includes a wall having at least one groove extending axially thereof and having a depth that is less than a thickness of said wall.

5. The silencer assembly of claim 1, wherein said second C-shaped member comprises an expansion spring member.

6. The silencer assembly of claim 5, wherein said expansion spring member comprises a C-shaped flat spring member.

7. The silencer assembly of claim 5, wherein said expansion spring member is made of stainless steel.

8. A silencer assembly comprising:

(a) a hollow tube member including a wall having an exterior surface and an interior surface defining an interior cavity having a predetermined inside diameter, said wall having at least one groove extending axially thereof and having a depth that is less than a thickness of said wall;

(b) a C-shaped member inserted into said interior cavity of said first hollow tube member for preventing early relaxation of said first hollow tube member, thus extending a life of said first hollow tube member and making the silencer assembly easily recyclable by merely inserting said C-shaped member into said interior cavity; and (c) at least one partially compressed preformed high density polymeric open cell foam plug within said interior cavity of said hollow tube member.

9. The silencer assembly of claim 8 wherein said first wall includes a slot in said wall extending axially thereof.

10. The silencer assembly of claim 8, wherein said polymeric open cell foam plug in an uncompressed state has a substantially circular cross section.

11. The silencer assembly of claim 8, wherein said polymeric open cell foam plug is inserted inside said C-shaped member.

12. The silencer assembly of claim 8, wherein said polymeric open cell foam plug has a first portion inserted inside said C-shaped member, and a second portion inserted between an exterior surface of said C-shaped member and said first wall of said first hollow tube member.

13. An electrostatographic reproduction machine comprising:

(a) a moveable imaging member having an exterior image bearing surface;

(b) imaging devices for forming a toner image on said image bearing surface;

(c) a transfer assembly for transferring the toner image onto a copy sheet;

(d) a cleaning blade assembly for cleaning said image bearing surface in preparation for the forming of another toner image; and (f) an extended life and recycleable silencer assembly for reducing screeching noises between said cleaning blade assembly and said image bearing surface of said imaging member, the silencer assembly including:

(i) a first C-shaped member having a hollow interior and an exterior surface for contacting an interior surface of said imaging member;

(ii) a second C-shaped member inserted into said hollow interior of said first C-shaped member for preventing early relaxation of said first C-shaped member, thus extending a life of said first C-shaped member and making the silencer assembly easily recyclable by merely adding said second C-shaped member; and (iii) at least one partially compressed preformed high density polymeric open cell foam plug inserted within said hollow interior of said first C-shaped member.

14. The electrostatographic reproduction machine of claim 13, wherein said imaging member comprises a hollow drum.

* * * * *